United States Patent [19]

Butka

[11] Patent Number: 4,702,192

[45] Date of Patent: Oct. 27, 1987

[54] VESSEL SUCH AS SHIP, BOAT AND THE LIKE WITH STABILIZING MEANS

[76] Inventor: Kemal Butka, 372 Central Park W., Apt. 20J, New York, N.Y. 10025

[21] Appl. No.: 872,672

[22] Filed: Jun. 10, 1986

[51] Int. Cl.[4] ..... B63B 39/02

[52] U.S. Cl. ..... 114/122; 114/124

[58] Field of Search ..... 114/91, 121, 122, 124, 114/140, 143, 191, 350

[56] References Cited

U.S. PATENT DOCUMENTS

| | | | |
|---|---|---|---|
| 683,260 | 9/1901 | Dysart | 114/350 |
| 1,101,451 | 6/1914 | Kinney | 114/191 |
| 1,215,233 | 2/1977 | Alford | 114/191 |
| 1,577,475 | 3/1926 | Liska | 114/350 |
| 2,901,208 | 8/1959 | Jones | 114/191 |
| 3,044,082 | 7/1962 | Gordon | 114/350 |

FOREIGN PATENT DOCUMENTS

| | | | |
|---|---|---|---|
| 2040234 | 8/1980 | United Kingdom | 114/191 |

*Primary Examiner*—Jeffrey V. Nase
*Assistant Examiner*—Stephen P. Avila
*Attorney, Agent, or Firm*—Michael J. Striker

[57] ABSTRACT

A vessel, such as a ship, a boat and the like, comprises an inner hull having a longitudinal horizontal axis and a transverse horizontal axis, an outer hull surrounding the inner hull and arranged movable relative to the latter about at least one of the horizontal axes, and a plurality of ball bodies arranged between the inner hull and the outer hull so as to allow the movement of the outer hull relative to the inner hull about the at least one horizontal axis.

12 Claims, 3 Drawing Figures

VESSEL SUCH AS SHIP, BOAT AND THE LIKE WITH STABILIZING MEANS

BACKGROUND OF THE INVENTION

The present invention relates to a vessel such as a ship, a boat and the like. More particularly, it relates to a ship, a boat and the like provided with stabilizing means.

It is known to provide a stabilizing means in ships, boats for the purpose of reducing their rolling motion. In general, the stabilizing means respond to the force of wind and waves and perform corrective actions. An active stabilizer has a preset control, whereby the corrective action in form of counteracting movement takes place simultaneously with the occurrance of the destabilizing movement that causes the rolling of the ship, boat and the like. The known stabilizing means include from simple bilge keels to retractable keels, and more advanced gyrostabilizers. These devices contribute to correcting the disturbances by performing corresponding actions. However, they do not guarantee keeping the ships, boats and the like in a continuous stable and balanced position.

SUMMARY OF THE INVENTION

Accordingly, it is an object of the present invention to provide a vessel, such as a ship, a boat and the like which avoids the disadvantages of the prior art.

In keeping with these objects and with others which will become apparent hereinafter, one feature of the present invention resides, briefly stated, in a ship, a boat and the like which has an inner hull with a longitudinal horizontal axis and a transverse horizontal axis, an outer hull which is movable relative to said inner hull about at least one of said horizontal axes and a plurality of ball elements located between said inner hull and said outer hull so as to allow movement of said outer hull relative to said inner hull on the ball members. In accordance with a preferred embodiment of the invention, the outer hull is movable relative to the inner hull about both horizontal axes of the latter.

When the ship, boat and the like is designed in accordance with the present invention, a balancing system is provided by means of physically isolating the ship, boat and the like from natural disturbing forces which conventionally cause rolling and heeling of ships and boats. The outer hull responds to the forces of wind and waves, but does not transmit them to the inner hull which remains in balance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
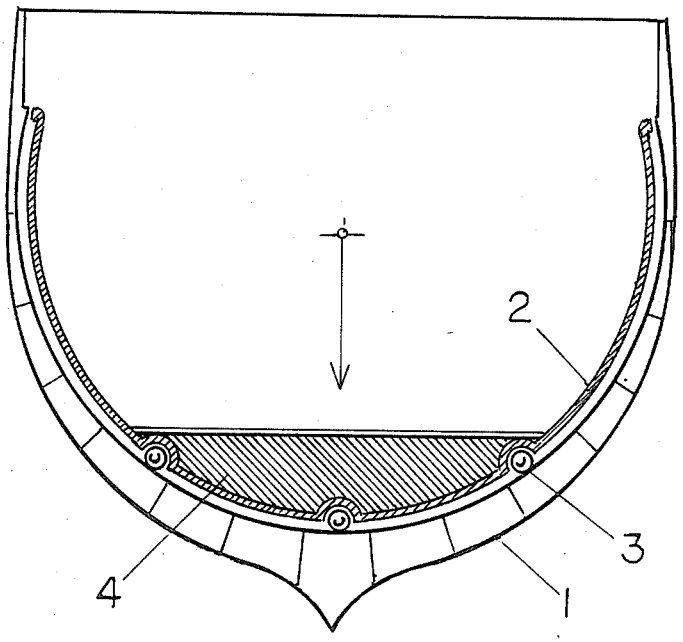
FIG. 1 is a front view of a boat in accordance with the present invention, in section.

A vessel formed as a boat in accordance with the present invention, as shown in FIG. 1, has an outer hull which is identified with reference numeral 1 and an inner hull which is identified with reference numeral 2. The inner hull 2 is arranged inside the outer hull 1 so as to retain a small gap therebetween. A plurality of ball members or bodies 3 are arranged between the outer hull 1 and the inner holl 2 so as to separate them from one another and to allow movement of the outer hull relative to the inner hull on the ball bodies 3. As a result of this the outer hull 1 is movable (turnable) relative to the inner hull 2 about a longitudinal horizontal axis. When the forces of wind and waves act on the boat, they are applied to the outer hull 1. However, since the outer hull 1 is movable relative to the inner hull 2, these forces are not transmitted in the transverse direction to the inner hull 2 and the latter remains in a substantially balanced condition. The most disturbing rolling motion which adversely affects passengers and crew is therefore eliminated. As can be seen from FIG. 1, the inner hull 2 is provided with a bottom ballast which is in general known per se in the art.

Figure 2:
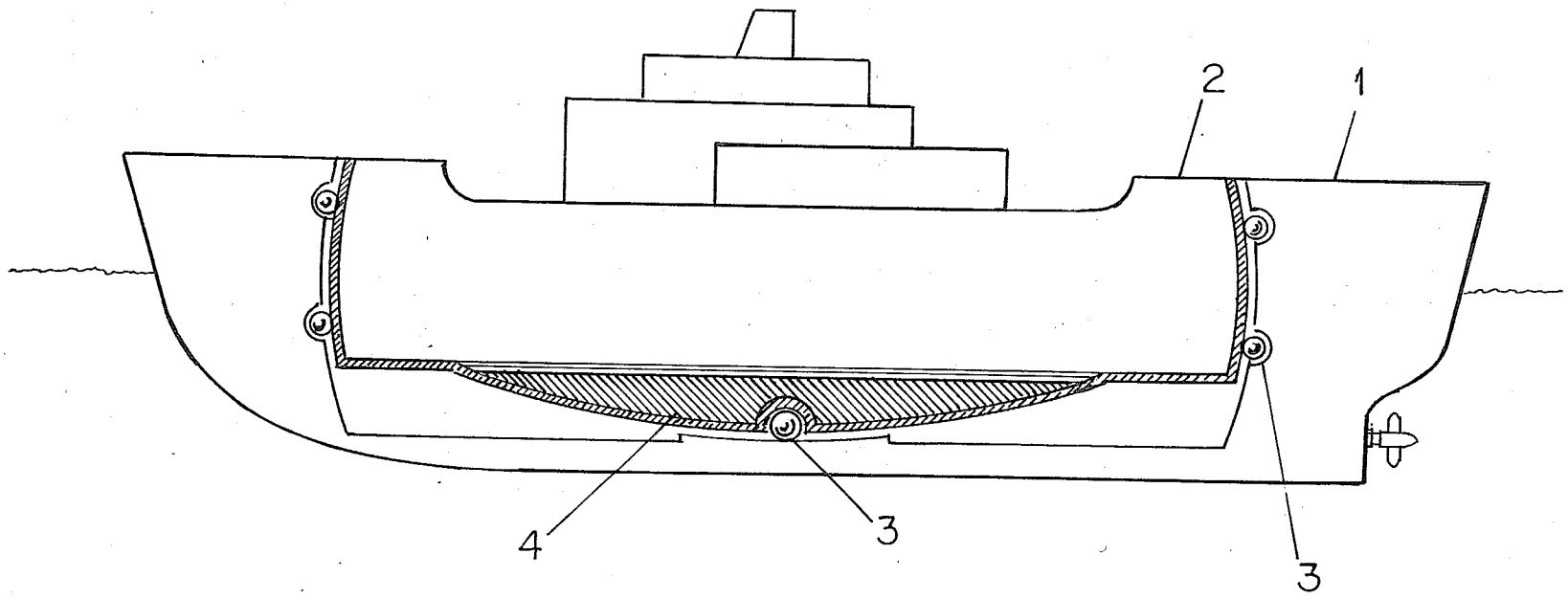
FIG. 2 is a side view of the inventive boat of FIG. 1, also in section.

As can be seen from FIG. 2, the outer hull 1 is also movable (turnable) in accordance with the present invention relative to the inner hull 2 about a transverse horizontal axis. For this purpose, an additional space is provided between the bottom of the inner hull 2 and the inner surface of the outer hull 1. Also, in addition to ball bodies located in the bottom region of the inner hull 1 and the outer hull 2, additional ball bodies 3 are provided between the longitudinally spaced outer surfaces of the inner hull 2 and respective longitudinally spaced inner surfaces of the outer hull 2. When a ship, boat and the like is designed as shown in FIG. 2, the forces of wind and waves act upon the outer hull 1, but are not transmitted in the longitudinal direction to the inner hull 2. Thereby the heeling motion which also adversely affects passengers and crew, is eliminated.

In accordance with the applicant's invention, the outer hull 1 can be made movable relative to the inner hull 2 either about the longitudinal horizontal axis as shown in FIG. 1 or about a transverse horizontal axis as shown in FIG. 2. In accordance with a preferable embodiment of the invention, the outer hull 1 is turnable relative to the inner hull 2 about both horizontal axes, namely about the longitudinal horizontal axis and the transverse horizontal axis of the inner hull. In this case the rolling motion and the heeling motion of the inner hull is prevented. The inner hull which supports passengers and crew is subjected only to a vertical movement upwardly and downwardly, and therefore a substantially more comfortable travel for passengers and crew is provided.

FIGS. 1 and 2 show the ball bodies 3 retained in cages or sockets which are formed in the inner hull 2. However, it is to be understood that the ball bodies 3 can be retained also in cages or sockets formed in the outer hull 1, or retained in any other manner to provide rolling of the outer hull relative to the inner hull.

Figure 3:
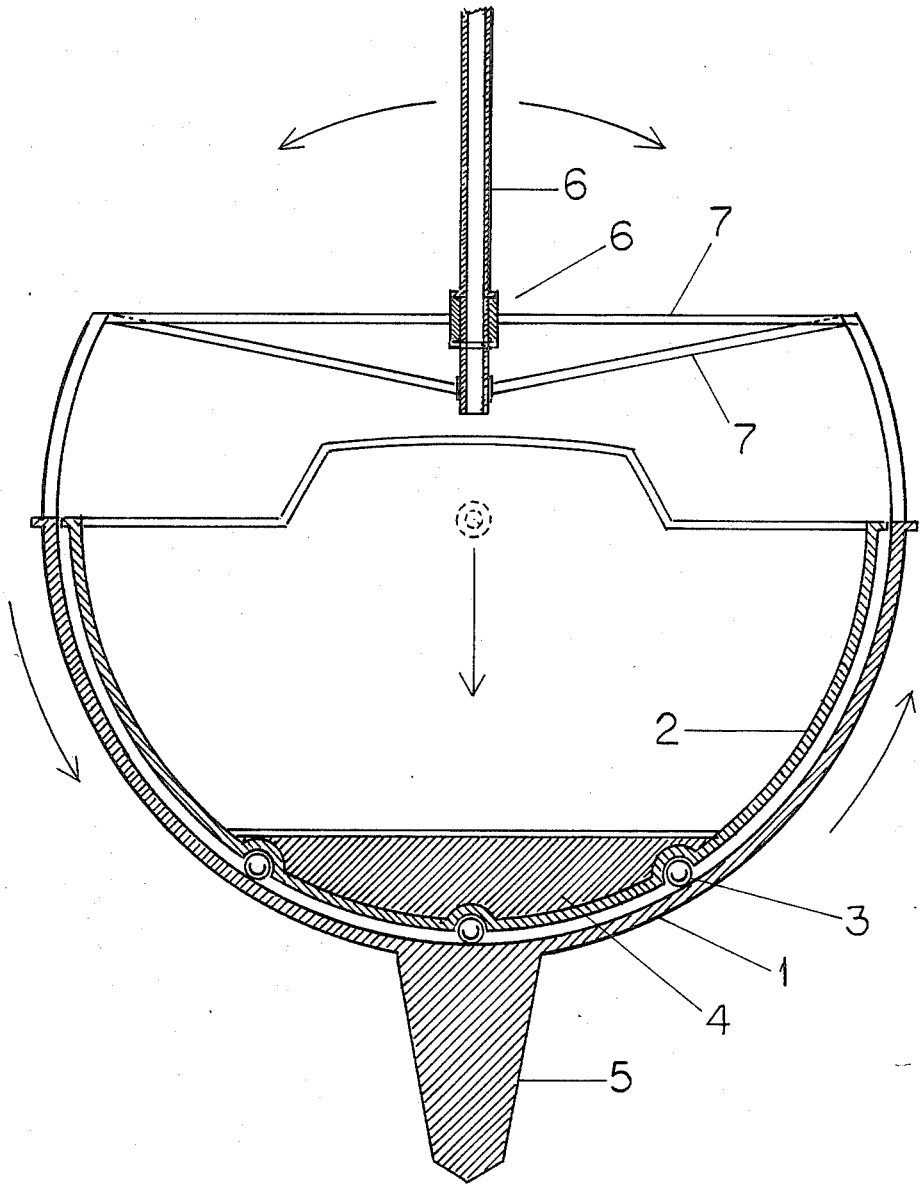
FIG. 3 is a front view of the boat in accordance with a further embodiment, also in section.

In the embodiment shown in FIG. 3, a mast 6 is connected by its lower end 6′ with the outer hull 1 via attachment members 7 and 7′. When the forces of wind act on the mast 6, it is turned and forcibly turns the outer hull 1 about a longitudinal horizontal axis relative to the inner hull 2. Again, the ball bodies 3 are arranged between the outer hull 1 and the inner hull 2. The inner hull 2 is provided with the bottom ballast 4, while the outer hull 1 is provided with a ballast 5.

It will be understood that each of the elements described above, or two or more together, may also find a useful application in other types of constructions differing from the types described above.

While the invention has been illustrated and described as embodied in a vessel, such as a ship, a boat and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vessel, such as a ship, a boat and the like, comprising an elongated inner hull having a longitudinal horizontal axis and a transverse horizontal axis; an elongated outer hull surrounding said inner hull and arranged movable relative to the latter about both said horizontal axes; and a plurality of ball bodies arranged between said elongated inner hull and said elongated outer hull so as to allow the movement of said elongated outer hull relative to said elongated inner hull about both said horizontal axes, said elongated inner hull and said elongated outer hull being arranged relative to one another so that therebetween a space is formed which allows the movement of said elongated inner hull relative said elongated outer hull about said transverse horizontal axis, with said elongated inner hull moving in said space.

2. A vessel as defined in claim 1, wherein said inner housing has two longitudinally spaced ends, said space being formed so that during movement of said inner hull relative to said outer hull about said transverse horizontal axis, one longitudinal end of said inner hull moves downwardly in said space, while the other longitudinal end of said inner hull moves upwardly in said space.

3. A vessel as defined in claim 1, wherein said inner hull has two longitudinally spaced ends, said ball bodies being arranged between said inner and outer hulls at a predetermined location between said longitudinal ends, and said space increasing into opposite direction from said predetermined location toward said longitudinal ends of said inner hull.

4. A vessel as defined in claim 1, wherein said inner hull has an outer surface, said outer hull having an inner surface facing toward said outer surface of said inner hull, said bodies being located substantially between said outer surface of said inner hull and said inner surface of said outer hull.

5. A vessel as defined in claim 4; and further comprising means for retaining said balls, said retaining means being provided in at least one of said outer surface of said inner hull and said inner surface of said outer hull and partially surrounding said ball bodies so as to rotatably hold the latter.

6. A vessel as defined in claim 4, wherein said outer surface of said inner hull and said inner surface of said outer hull each have a bottom surface portion, said ball bodies being arranged between said bottom surface portions of said inner hull and said outer hull.

7. A vessel as defined in claim 4, wherein said outer surface of said inner hull and said inner surface of said outer hull each have longitudinally spaced side surface portions, said ball bodies being located between said longitudinally spaced side surface portions of said inner hull and said outer hull.

8. A vessel as defined in claim 4, wherein said outer surface of said inner hull and said inner surface of said outer hull each have a bottom surface portion and longitudinally spaced side surface portions, said ball bodies being located between said bottom surface portions and between said longitudinally spaced side surface portions of said inner hull and said outer hull.

9. A vessel as defined in claim 1; and further comprising ballast means provided in said inner hull.

10. A vessel as defined in claim 9, wherein said inner hull has a bottom portion, said ballast means being located in said bottom portion of said inner hull.

11. A vessel as defined in claim 1; and further comprising ballast means provided in said outer hull.

12. A vessel as defined in claim 11, wherein said outer hull has a bottom portion, said ballast means being provided in said bottom portion of said outer hull.

* * * * *